United States Patent [19]

Antos et al.

[11] Patent Number: 4,712,255

[45] Date of Patent: Dec. 15, 1987

[54] PORTABLE TOILET WITH VALVE ACTUATING HANDLE THAT AUTOMATICALLY LOCKS THE VALVE IN CLOSED POSITION DURING EMPTYING OF THE HOLDING TANK

[75] Inventors: John M. Antos, Ann Arbor; John R. Selina, Ypsilanti, both of Mich.

[73] Assignee: Thetford Corporation, Ann Arbor, Mich.

[21] Appl. No.: 898,466

[22] Filed: Aug. 20, 1986

[51] Int. Cl.[4] ..... E03D 1/00; A47K 11/02; A47K 11/03

[52] U.S. Cl. ..... 4/323; 4/321; 4/460; 4/459; 222/533; 222/566; 222/567

[58] Field of Search ..... 4/321, 661, 460, 459, 4/458, 449, 471, 322, 323; 137/269, 587, 318; 222/566, 567, 533, 478, 570; 288/401, 376, 360, DIG. 18; 220/855 P, 226

[56] References Cited

U.S. PATENT DOCUMENTS 858,900 7/1907 McNutt ..... 137/587

4,125,207 11/1978 Ernst et al. ..... 222/533

4,570,273 2/1986 Antos et al. ..... 4/321

4,641,383 2/1987 Sargent et al. ..... 4/460 X

*Primary Examiner*—Henry K. Artis

*Attorney, Agent, or Firm*—Harness, Dickey & Pierce

[57] ABSTRACT

A portable toilet with a movable spout via which accumulated waste contents are dumped at a suitable sanitary disposal station. The portable toilet has separably mounted seat and holding tank sections which are separated for dumping. The spout is rotatably mounted in an aperture in the top wall of the holding tank and is swung from its stored position to a discharge position extending away from the holding tank and the one dumping the tank. A vent valve is also provided in the top wall of the holding tank and it is manually operated by the person dumping the holding tank so as to vent the head space during dumping, and a waste inlet valve on the tank is locked in its closed position during dumping by an auto lock actuating handle which is located adjacent the vent valve and provides a convenient holding handle for the tank during dumping.

5 Claims, 12 Drawing Figures

PORTABLE TOILET WITH VALVE ACTUATING HANDLE THAT AUTOMATICALLY LOCKS THE VALVE IN CLOSED POSITION DURING EMPTYING OF THE HOLDING TANK

BACKGROUND AND SUMMARY OF THE INVENTION

This invention relates to portable toilets and is particularly concerned with a new and improved arrangement for emptying the contents of the holding tank of a portable toilet.

A number of commonly assigned patents disclose portable toilets of the type which comprise a holding tank section and a seat section separably mounted on the holding tank section. The seat section comprises a bowl with a bottom outlet which registers with an opening in the top wall of the holding tank. When the two sections are mounted together the bowl outlet is in sealed relationship with the opening in the top wall of the holding tank. A valve in the holding tank is disposed at the opening and when the valve is operated the contents of the bowl drop into the holding tank. The accumulated contents of the holding tank are dumped from time to time at suitable sanitary disposal stations.

One usual practice has been to provide a threaded boss circumscribing an outlet opening and a threaded cap threaded onto the boss to close the opening. When the contents are to be dumped, the cap is unscrewed and the waste materials poured out. More recent holding tanks have been provided with a rotatably mounted discharge spout to facilitate flow of the tank contents out of the tank. Co-pending application Ser. No. 383,410, filed June 1, 1982, assigned to the Assignee of this application, disclosed such a discharge spout. In all cases, however, it is essential that the holding tank valve be kept closed during discharge to prevent an awkward and accidental spilling of the tank contents.

The present invention provides structure for automatically locking the valve actuating handle in a "valve closed" position to prevent accidental spilling of the tank contents during carrying and emptying of the tank.

Further advantages accrue in the disclosed preferred embodiment of the invention in which the improved arrangement comprises a rotatably mounted discharge spout on the exterior of the holding tank one end of which fits into an aperture in the top wall of the holding tank and the other end of which is closed by a removable cap.

In order to dump the contents of the holding tank the two toilet sections are separated and the spout is rotated away from its storage position to a position pointing away from the holding tank. The cap is removed, and the tank is tipped so that the waste contents are discharged from the far end of the spout.

In order to promote a smooth flowing discharge which is substantially immune from objectionable characteristics such as belching, a vent valve is provided on the wall of the holding tank for venting the interior head space during dumping. The disclosed embodiment of the vent valve comprises a normally closed spring biased element with an actuator positioned adjacent to a gripping portion of the toilet so that when the toilet is gripped for dumping it is particularly convenient for the person to operate the vent valve actuator concurrent with the grasping and tipping of the holding tank. After the dumping procedure has been completed, the cap is screwed onto the spout, and the spout is returned to its storage position. During dumping, the tank section is conveniently held by the valve actuating handle and the automatic handle locking feature of the invention prevents accidental opening of the valve.

The foregoing features, advantages and benefits of the invention along with additional ones, will be seen in the ensuing description and claims which should be considered in conjunction with the accompanying drawings.

The drawings disclose a preferred embodiment of the invention according to the best mode contemplated at the present time in carrying out the invention.

DESCRIPTION OF THE PREFERRED EMBODIMENT

Figure 1:
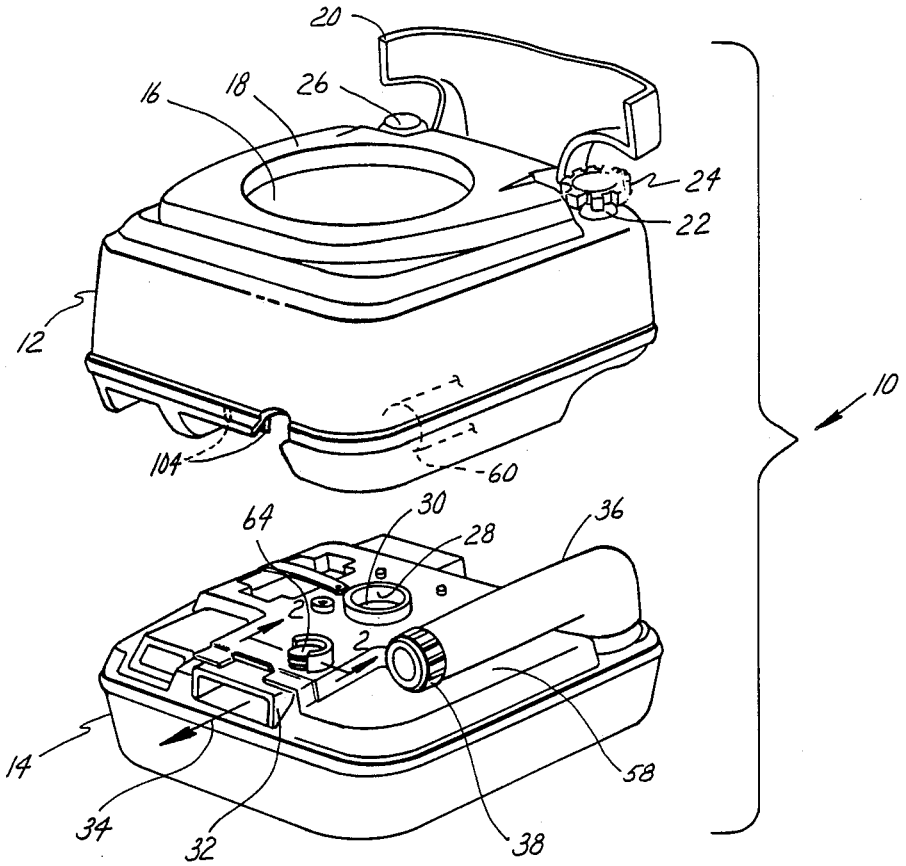
FIG. 1 is a perspective view having a portion broken away of an embodiment of portable toilet comprising principles of the present invention.

The portable toilet of this invention, indicated generally at 10 is shown in FIG. 1 as comprising a seat section 12 which separably mounts on a holding tank section 14 in a conventional manner. FIG. 1 shows the two sections separated. The seat section 12 comprises a bowl 16 and an overlying seat 18 and cover 20 which are hingedly mounted on this section. A flush water storage tank or chamber (not viewable) is provided within the interior of seat section 12 and it may be filled with fresh water via a fill port 22 which is covered by a removable cap 24.

A pumping mechanism 26 is also provided for pumping fresh water from the water storage chamber into bowl 16 for use. The bowl comprises a bottom outlet (not viewable) which registers with an inlet opening 28 in the top wall of holding tank 14. Opening 28 is closed by a slide valve 30 mounted within the interior of the holding tank. The slide valve is operated by a handle 32 which is disposed at the front wall of the holding tank section 14. In order to open valve 30 the operating handle 32 is moved in the direction of arrow 34. As valve 30 slides open, the contents of bowl 16 drop into the holding tank. Thereafter the operating handle is moved in the opposite direction to close valve 30. In this way holding tank 14 accumulates waste contents for later disposal at a suitable sanitary disposal station. Because of the separable mounting of the two sections 12 and 14 the holding tank section 14 can be removed for dumping.

Dumping of the holding tank contents is accomplished through a discharge spout 36 on holding tank 14. Spout 36 is a hollow tubular element having a right angle bend. One end is operatively engaged with the holding tank while the opposite end is closed by a removable cap 38. Details of the spout construction can be best seen in FIGS. 4 through 8.

The end of the spout on which cap 38 is disposed is provided with an integrally formed screw thread 40. Cap 38 has a similar thread which allows the cap to be screwed onto the end of the spout to close it. When the contents are to be dumped the cap is unscrewed and removed. Preferably a circular sealing gasket 42 is lodged within cap 38 so as to provide a seal between the end of the cap and the edge 44 of the spout at the discharge opening when the cap is fully tightened on the spout.

Figure 4:
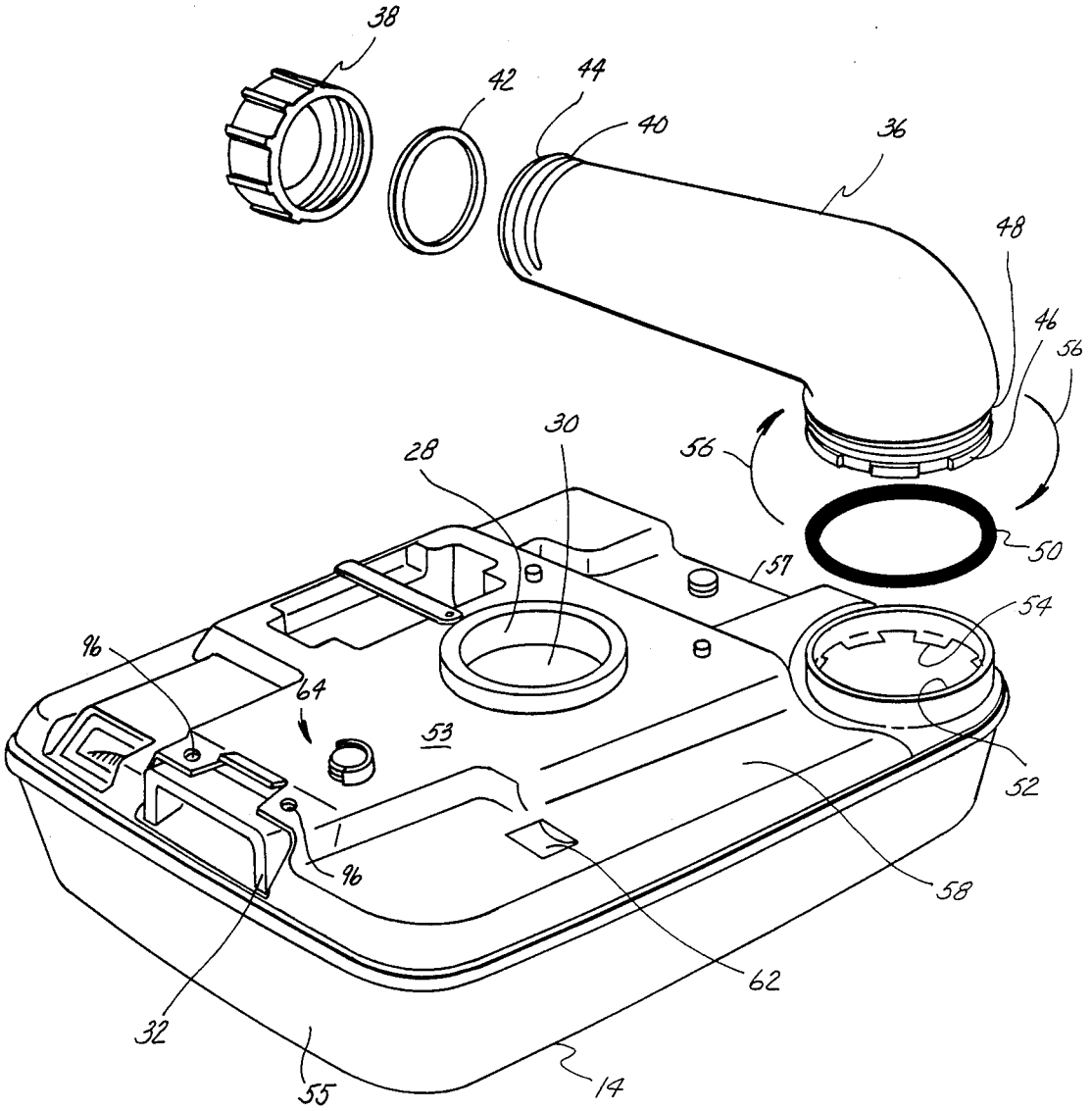
FIG. 4 is a partly exploded perspective view, on an enlarged scale, of one portion of the holding tank section shown in FIG. 1.
Figure 5:
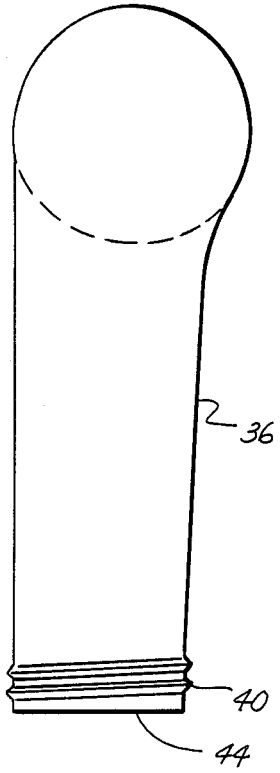
FIG. 5 is a top plan view of the spout shown by itself.
Figure 6:
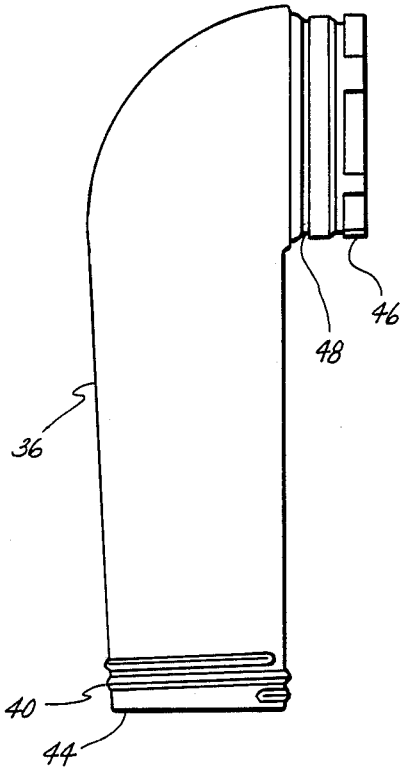
FIG. 6 is a right side view of the spout shown in FIG. 5.
Figure 7:
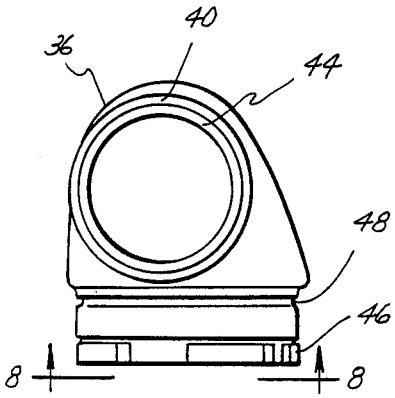
FIG. 7 is a front view of the spout shown in FIG. 5.
Figure 8:
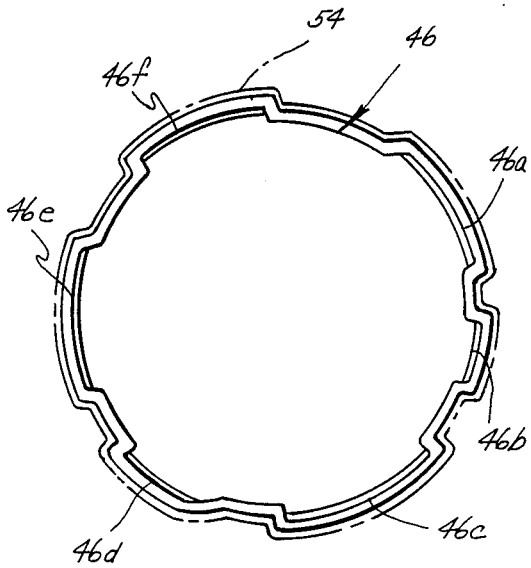
FIG. 8 is a view taken in the direction of arrows 8—8 in FIG. 7 and enlarged.

The opposite end of the spout is of a generally circular shape but it comprises a multi-lobed key 46. Specifically, the key 46 comprises six circumferentially spaced lobes which are identified by the reference numerals 46*a*, 46*b*, 46*c*, 46*d*, 46*e*, and 46*f* in FIG. 8. It also comprises a circular groove 48 adjacent to key 46 for an O-ring gasket seal 50 (FIG. 4).

The holding tank wall is provided with a circular walled aperture 52 within which the keyed end of spout 36 is disposed. A complementary mating key 54 (shown in phantom in FIG. 8) is disposed on the wall of aperture 52. Key 54 allows the spout to be fully inserted into aperture 52 only when the two keys are in circumferential registry. The arrangement of key 54 in relation to the holding tank is such that circumferential registry of the two keys 46, 54 occurs with the spout in the position shown in FIG. 4.

It will be observed that the holding tank has a generally rectangular shape, having a top wall 53 and a pair of opposite end walls 55 and 57, and that the aperture 52 is provided in the top wall 53 at one corner. Thus the installation position of the spout is such that the spout overlies the top wall and is generally parallel to the far shorter side wall as viewed in FIG. 4. The construction of aperature 52 and key 54 is such that when the spout is fully inserted into the aperture the key 46 is disposed just beyond the key 54. At this point the O-ring gasket 50 is engaged with the wall of the aperture so that a leakproof joint is thereby provided.

Next the spout is rotated in the direction of arrows 56. As key 46 leaves its circumferential registry with key 54, certain portions of the individual lobes of the keys are always in interlocking engagement which prevents the spout from coming out of the aperture. The dimensional relationships are such that this is true over all positions of a full circular revolution of the spout about the aperture. However, the illustrated construction is such that the operative range is less. When the spout has been rotated three quarters of a revolution from its insertion position, it occupies another position which once again overlies the top wall but is now parallel to the nearer longer side of the holding tank as viewed in FIG. 4. This is also the position which is illustrated in FIG. 1, and it constitutes a storage position for the spout.

In the storage position of the spout the two sections 12 and 14 may be mounted together. The two sections cooperatively define at their confronting surfaces a cavity which forms a storage housing for the spout when the spout is in the stored position. The illustrated construction is such that one portion of the storage housing may be considered as comprising the area identified by the reference numeral 58 in holding tank section 14 while the remainder is defined in section 12 by the portion designated by the reference numeral 60. The cavity forming the housing is integrally molded with the molded plastic sections 12 and 14. As can be seen in Fig. 4, a depression 62 is fashioned in the top wall of the holding tank. When spout 36, with cap 38 attached, is rotated to the storage position the lower edge portion of the cap lodges in the depression 62 and in this way the depression defines a locator for the storage position of the spout.

Figure 9:
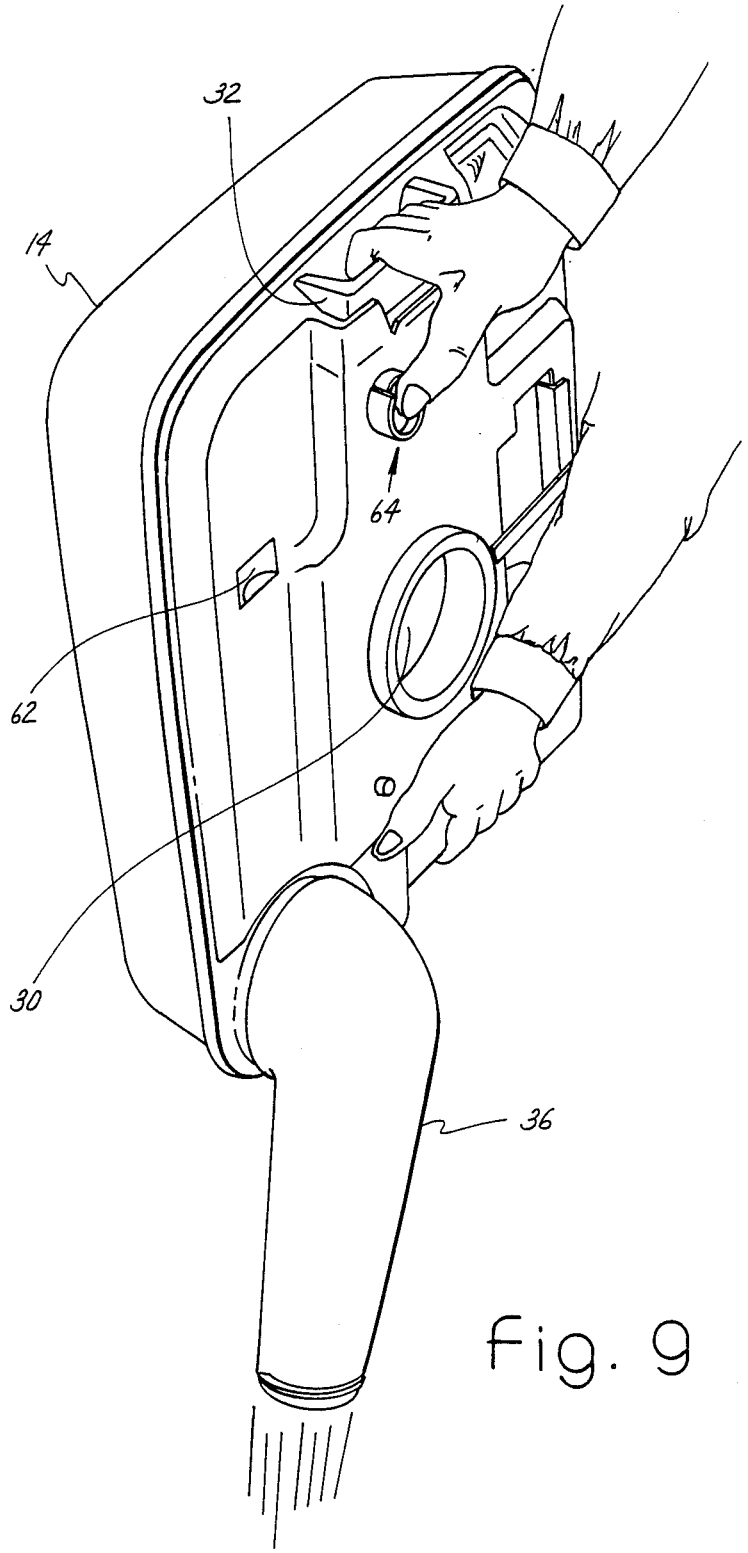
FIG. 9 is a perspective view illustrating the dumping procedure.

For dumping, seat section 12 is separated and removed from holding tank section 14 and the holding section is taken to an appropriate sanitary disposal station. The spout is swung away from its storage position and cap 38 is removed. The spout will typically be pointed away from the holding tank and will not normally come close to the installation-removal position. In other words, rotation to the installation-removal position would be contrary to the objective of dumping the tank, and therefore, accidental separation of the spout from the holding tank is essentially impossible. Moreover, when the spout is in other than its storage position, the two sections 12, 14 cannot be mounted together. FIG. 9 illustrates a typical dumping procedure and in that procedure the spout has been rotated from its storage position only about 180 degrees. This would probably be the most amount of rotation, and other typical positions would be somewhat less.

In order to promote a reasonably smooth discharge flow of the waste contents through the spout it has been found beneficial to include a venting means for directly venting the head space of the holding tank to atmosphere during dumping. Venting lessens greatly the tendency for belching or burping of discharging waste materials.

The disclosed embodiment comprises a vent valve 64 disposed on the top wall of the holding tank at the end somewhat opposite the end closest to the aperture 52. Details of the vent valve can be seen in FIGS. 2 and 3. The top wall of the holding tank is fashioned with an integral circular boss 66, the lower portion of which projects into the interior of the holding tank. The boss has a top wall 68 with a recess 69 formed centrally therein. Recess 69, at the bottom, comprises circular hole 70 concentric with the boss. Four arcuate vent openings 72 are in wall 68 extending around recess 69 on a common circle. Openings 72 provide, via the interior bore of boss 66, venting of the tank interior to atmosphere.

A valving element 74 comprises a bifurcated shank 76 which fits closely within hole 70. A circular actuator button 78 is at the top of shank 76 and a helical spring 80 is disposed around shank 76 and between the bottom wall of recess 69 and actuator button 78. The spring 80 biases the valving element 74 in the upward direction so as to urge a suitable closure portion 82 against the lower circular edge of boss 66 so as to close the interior bore of the boss and hence the vent openings 72. The illustrated construction for the closure portion comprises a rigid circular portion 84 which is affixed to the lower end of shank 76 within the holding tank and which supports an annular gasket 86 which seals against the lower circular edge of boss 66 when the valve is closed.

Figure 2:
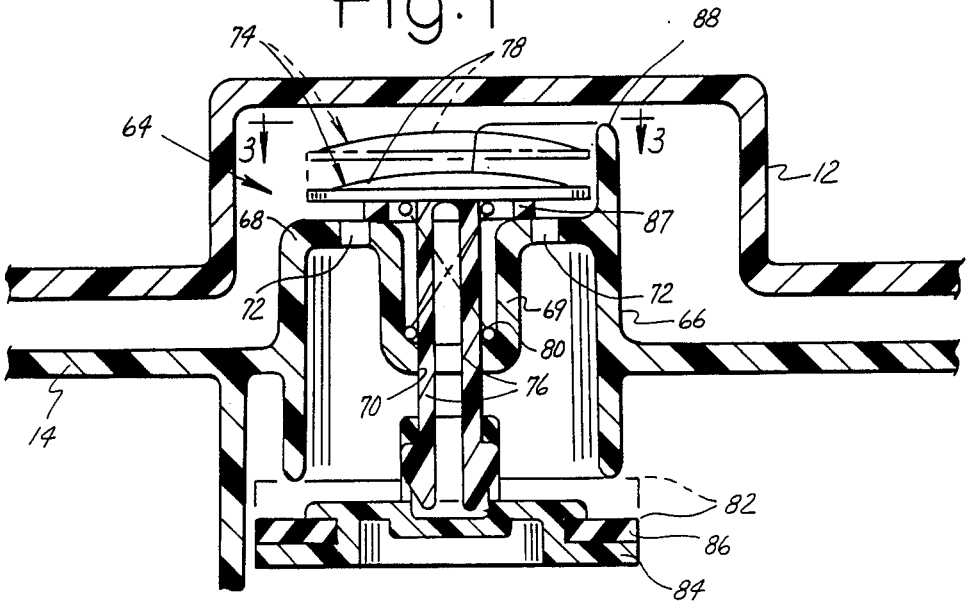
FIG. 2 is an enlarged vertical sectional view taken substantially in the direction of arrows 2—2 in FIG. 1.
Figure 3:
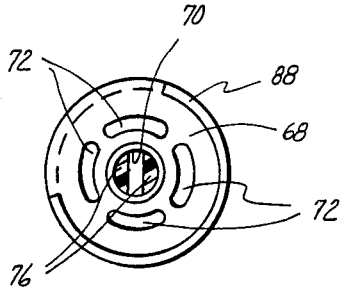
FIG. 3 is a horizontal sectional view, on a reduced scale, taken in the direction of arrows 3—3 in FIG. 2.

The broken line position shown in FIG. 2 thus represents the closed position to which the valving element 74 which is normally spring biased. In this position, the closure portion 82 prevents waste materials and vapors from passing through the vent openings 72. The solid line position illustrates the actuated position to which the valving element 74 is moved during dumping to vent the interior head space of the holding tank. It should be observed that a stop 87 is provided on button 78 for limiting downward displacement so that the button does not close off the vent openings when the valve is depressed. Thus, actuation of the valve always allows air to pass through openings 72 into the holding tank to prevent the creation of the partial vacuums which might give rise to belching and burping during dumping.

It will be further observed that the location of the vent valve 64 is adjacent to the operating handle 32. As can be appreciated from consideration of FIG. 9 the operating handle 32 also forms a portion of a grip which may be grasped by a person dumping the holding tank. The configuration is such that the person's fingers fit conveniently onto the handle with the actuator button being poised to be pushed by the thumb to the venting position. An upstanding lip 88 extends partially around (slightly more than a semi-circle) the outside of the top wall 68 of the boss 66. The upper edge of lip 88 is above button 78 when the valve is closed and it forms a protector against inadvertent actuation of the valve. It also assists in preventing thumb slippage while the button is being depressed. Thus function and convenience are greatly promoted by the arrangement.

Because the vent 64 is located adjacent end wall 55, at generally opposite the end wall 57 closest to the discharge spout 36, it will inherently be exposed to the head space of the tank during dumping, the tank being designed to leave a head space when its liquid waste content is completely full. Accordingly, liquid waste will not accidentally pass through the openings 72.

Figure 10:
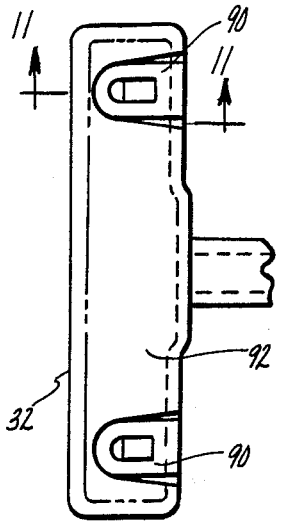
FIG. 10 is a top view of the valve actuating handle.
Figure 11:
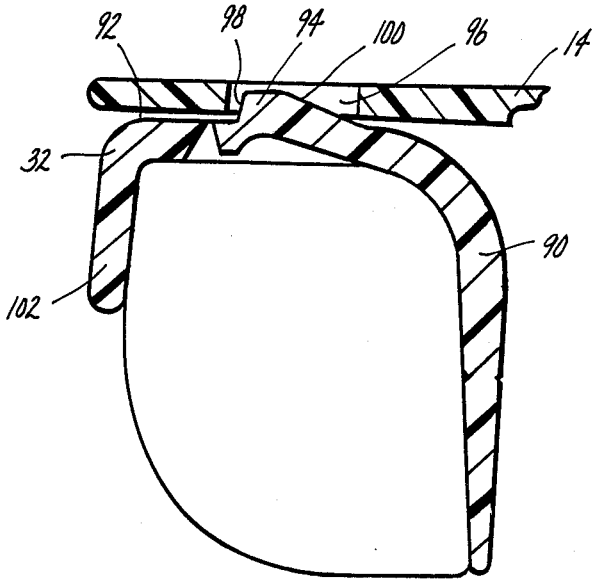
FIG. 11 is a fragmentary enlarged sectional view of the handle shown in FIG. 10, as seen from substantially the line 11—11 in FIG. 10, and showing the handle in its valve locking position on the holding tank.

As best appears in FIG. 10, the handle 32 is provided with a pair of resilient tab fingers 90 which are integrally formed at their lower ends with the rear side of the handle 32 and extend upwardly so that they are located generally in the top surface 92 of the handle 32. Each of the fingers 90 includes an upwardly extending locking projection 94 which is alignable with an opening 96 in the holding tank 14. As shown in FIG. 11, the projection 94 has an upright front surface 98 and a tapered rear surface 100 for a purpose to appear presently.

Figure 12:
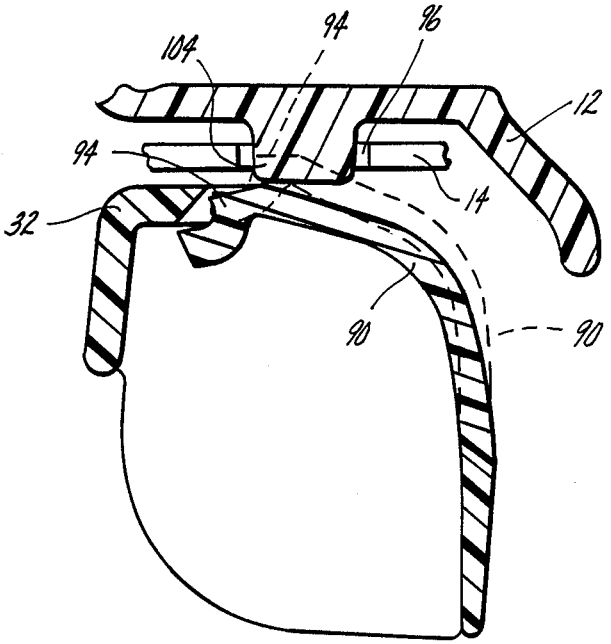
FIG. 12 is a fragmentary sectional view of the handle, like FIG. 11, showing the locking tabs on the handle moved to unlocking positions by the seat section of the toilet when the seat and holding tank sections are assembled.

When the fingers 90 are in positions in which the projections 94 extend into the openings 96, the handle 32 which is normally gripped by its downwardly extending front wall 102 cannot be moved in the direction of the arrow 34 in FIG. 1 because of the engagement of the stop surface 98 on the projection 94 with the holding tank 14. The openings 96 function as sockets for the projections 94 because the projections 94 will snap into the openings 96, as shown in FIG. 12, whenever openings and projections are aligned and the toilet sections 12 and 14 are separated.

The fingers 90 automatically assume the positions shown in FIG. 11 when the seat section 12 is removed or separated from the holding tank section 14 because of the inherent shape of the fingers 90 which conform generally to the shape of the handle 32 in which they are located. However, when the seat section 12 is positioned on the tank section 14, downwardly extending projections or pins 104 (FIGS. 1 and 12) on the seat section 12 align with the openings 96 and engage the projections 94 so as to depress the projections 94 and the fingers 90 to the positions illustrated in FIG. 12 in which the projections 94 are in a clearance relation with the openings 96. As a result, the handle 32 can then be operated to open the valve 30 by moving the handle in the direction of the arrow 34 and close the valve 30 by moving the handle 32 in an opposite direction in which the projection surfaces 100 engage the tank section 14 so as to progressively depress the projections 94 and allow the handle 32 to be moved inwardly to its position shown in FIG. 1.

When the handle 32 is in the position shown in FIG. 1, corresponding to a closed position of the valve 30, the valve 30 is effectively locked in its closed position because of the location of the projections 94 and the openings 96 as illustrated in FIG. 11. Thus, at all times when the tank section 14 is being emptied, as illustrated in FIG. 9, the valve 30 is positively locked in a closed position by the projections 94 so as to positively avoid any awkward spilling of the tank contents through the opening 28 that is closed by the valve 30.

The particular constructional details of the seat and holding tank sections, the vent valve and the spout may be accomplished with conventional materials and techniques. In accordance with typical manufacturing procedures the tank sections are fabricated from two injection molded halves having mating perimeters. The mating perimeters are mated and sealed to form the enclosure. The spout may also advantageously be fabricated from plastic and it may be manufactured by any suitable plastic forming technique such as injection molding or blow molding. The vent valve components are also plastic, with the exception of spring 80, and the element 86 being a suitable elastomeric material. The assembly of the vent valve to the holding tank may be accomplished by fabricating the valving element 74 and the closure portion 82 as separate pieces which are assembled together once they are in the correct position. The illustrated construction of bifurcated shank 76 includes catches at the distal end and the element 84 includes slots. The attachment involves the end of shank 76 snapping onto element 84 at the inside of the top wall of the tank so that the catches lodge in the slots. Other alternative attachment procedures can also be used.

The invention promotes conveniences in dumping because the point at which the waste contents exit the spout is more remotely located from the person than would be the case with prior types. The use of the venting valve promotes smoother discharge flow and hence there is a significant reduction in an individual's concern about waste contents splashing back. The locked valve actuating handle 32 insures against accidental spillage of the tank contents at the discharge valve 30 during carrying of the tank to an emptying location and during emptying of the tank. The handle 32 is automatically released for sliding in the direction of arrow 34 when the seat section 12 is replaced on the tank section 14. The construction is also advantageous in that the spout is stored interiorly of the unit and does not protrude, except at dumping. The unit retains overall compactness yet possesses improved function.

While a preferred embodiment has been disclosed, it will be appreciated that other embodiments are contemplated within the scope of the following claims.

What is claimed is:

1. In a portable toilet having a holding tank section and a seat section separably mounted on the holding tank section, said seat section including a bowl and said holding tank section including a valve which is operable to allow contents of the bowl to be deposited into the holding tank, a discharge spout via which the contents of the holding tank may be emptied after the seat section has been removed from the holding tank, a handle for operating said valve, means releasably locking said handle in a position maintaining said valve in its closed position in response to removal of said seat section from said holding tank section to insure that said valve is closed during emptying and carrying of said holding tank.

2. The improvement set forth in claim 1 in which said handle is mounted for back and forth translatory movement on said tank section, said locking means comprising coacting projection and socket means on said handle and said holding tank section operable to maintain said handle in a position corresponding to said closed position of said valve in response to separation of said seat and tank sections.

3. The improvement set forth in claim 2 in which said projection means is on said handle and further including yieldable finger means on said handle supporting said projection means and urging said projection means toward said socket means.

4. The improvement set forth in claim 3 further including downwardly extending pins on said seat section positioned to extend into said openings when the seat section is mounted on said tank section, said pins being operable to block movement of said handle projections into said openings and thereby prevent locking of said handle in a fixed position on said holding tank section.

5. In a portable toilet having a holding tank section, said holding tank section having a top wall and a pair of end walls, and a valve in said top wall which is operable to allow waste to be deposited into said holding tank, the improvement which comprises an aperture in said top wall, a discharge spout separably mounted on said holding tank at said aperture and operable between a storage position overlying said top wall and a discharge position pointing away from the holding tank section so that the discharge end of the spout is outwardly spaced from the holding tank section, and normally closed vent valve means also disposed in said top wall and operable during emptying of the holding tank via said discharge spout for venting the head space of the holding tank, said aperture being disposed adjacent one of said end walls, said normally closed vent valve means being disposed adjacent the other one of said end walls, a handle for oeprating said valve, means releasably locking said handle in a position adjacent said other one of said end walls, said handle in said locked position maintaining said valve in its closed position to insure that said valve is closed during emptying of said holding tank, thereby preventing undesirable spilling of waste through said valve.

* * * * *